US010001285B2

(12) United States Patent
Yamauchi et al.

(10) Patent No.: US 10,001,285 B2
(45) Date of Patent: Jun. 19, 2018

(54) OUTDOOR UNIT OF AIR CONDITIONER

(71) Applicant: Toshiba Carrier Corporation, Kanagawa (JP)

(72) Inventors: Hirofumi Yamauchi, Fuji (JP); Kazuhisa Sato, Fuji (JP); Hiroyuki Niwa, Fuji (JP); Takamasa Okuma, Fuji (JP)

(73) Assignee: TOSHIBA CARRIER CORPORATION, Kanagawa (JP)

( * ) Notice: Subject to any disclaimer, the term of this patent is extended or adjusted under 35 U.S.C. 154(b) by 249 days.

(21) Appl. No.: 14/524,295

(22) Filed: Oct. 27, 2014

(65) Prior Publication Data

US 2015/0040609 A1 Feb. 12, 2015

Related U.S. Application Data

(63) Continuation of application No. PCT/JP2013/062424, filed on Apr. 26, 2013.

(30) Foreign Application Priority Data

Apr. 27, 2012 (JP) ..... 2012-102095

(51) Int. Cl.
*F25B 39/04* (2006.01)
*F24F 1/68* (2011.01)
(Continued)

(52) U.S. Cl.
CPC ..... *F24F 1/68* (2013.01); *F24F 1/46* (2013.01); *F24F 1/58* (2013.01); *F24F 1/60* (2013.01)

(58) Field of Classification Search
CPC ..... F24F 1/68; F24F 1/46; F24F 1/54; F24F 1/28; F24F 1/30; F24F 1/60; F24F 1/56; F24F 1/50; F24F 13/20
See application file for complete search history.

(56) References Cited

U.S. PATENT DOCUMENTS

2009/0077988 A1* 3/2009 Ishikawa ..... F24F 1/22 62/259.1
2010/0294466 A1* 11/2010 Shimaoka ..... F24F 1/24 165/104.33

FOREIGN PATENT DOCUMENTS

EP 1443282 A1 * 8/2004 ..... F24F 1/38
JP H04 208331 A 7/1992
(Continued)

OTHER PUBLICATIONS

May 11, 2016 Chinese official action (including English translation) in connection with corresponding Chinese patent application No. 201380022388.9.

(Continued)

*Primary Examiner* — Len Tran
*Assistant Examiner* — Kamran Tavakoldavani
(74) *Attorney, Agent, or Firm* — John P. White; Cooper and Dunham LLP

(57) ABSTRACT

According to one embodiment, an object of the present invention is to provide an outdoor unit of an air conditioner which is basically composed of small-size component parts and can have a large air-conditioning capacity by stacking the small-size component parts in a vertical direction in accordance with a required air-conditioning capacity. The outdoor unit of an air conditioner includes an outdoor heat exchanger, an air-blower assembly including an air exchanger, and a housing accommodating the outdoor heat exchanger and the air-blower assembly. The outdoor heat exchanger, the air-blower assembly and the housing, and another outdoor heat exchanger, another air-blower assembly and another housing are configured to be stackable on each other in a vertical direction.

7 Claims, 17 Drawing Sheets

(51) Int. Cl.

| | |
|---|---|
| ***F24F 1/58*** | (2011.01) |
| ***F24F 1/60*** | (2011.01) |
| ***F24F 1/46*** | (2011.01) |

(56) References Cited

FOREIGN PATENT DOCUMENTS

| | | | | |
|---|---|---|---|---|
| JP | 7-32425 | | | 6/1995 |
| JP | 1995-32425 | U | * | 6/1995 |
| JP | 10-300134 | A | | 11/1998 |
| JP | 2002039572 | A | * | 2/2002 |
| JP | 2008-133986 | A | | 6/2008 |
| JP | 2008-267727 | A | | 11/2008 |

OTHER PUBLICATIONS

Notification of Transmittal of Translation of the International Preliminary Report on Patentability (Chapter I or Chapter II), including an International Preliminary Report on Patentability and Written Opinion of the International Searching Authority, dated Nov. 6, 2014 by the International Bureau of WIPO in connection with PCT International Application No. PCT/JP2013/062424, filed Apr. 26, 2013.

CD-ROM of the specification and drawings annexed to the request of Japanese Utility Model Application No. 62373/1993 (Laid-open No. 32425/1995), Jun. 16, 1995, Fujitsu General Ltd.

Notification of Transmittal of the International Search Report and the Written Opinion of the International Searching Authority, or the Declaration, including an International Search Report and Written Opinion of the International Searching Authority, dated Aug. 6, 2013 in connection with PCT International Application No. PCT/JP2013/062424, filed Apr. 26, 2013.

Supplementary European Search Report completed Feb. 24, 2016 in connection with European Patent Application No. 13782059, filed Apr. 26, 2013.

* cited by examiner

OUTDOOR UNIT OF AIR CONDITIONER

CROSS REFERENCE TO RELATED APPLICATIONS

This application is a Continuation application of PCT Application No. PCT/JP2013/062424, filed Apr. 26, 2013 and based upon and claiming the benefit of priority from Japanese Patent Application No. 2012-102095, filed Apr. 27, 2012, the entire contents of all of which are incorporated herein by reference.

FIELD

Embodiments described herein relate generally to an outdoor unit of an air conditioner, which can be composed of a single stage or a plurality of types in accordance with a required air-conditioning capacity.

BACKGROUND

With respect to an air conditioner comprised of an indoor unit and an outdoor unit, the number of indoor units varies in accordance with the extent of air-conditioned space, and the air-conditioning capacity of an outdoor unit needs to vary accordingly. That is, in the outdoor unit, the sizes of component parts vary in accordance with the degree of a required maximum air-conditioning capacity (for example, Jpn. Pat. Appln. KOKAI Publication No. 2008-133986).

DETAILED DESCRIPTION

In this manner, in an outdoor unit, the sizes of a heat exchanger, an air blower, a housing, etc., which are component parts vary in accordance with the degree of a required maximum air-conditioning capacity. Thus, in each case, it has been necessary to invest in molds adapted to required sizes, respectively.

In particular, if an outdoor unit of large capacity is developed, the size of a metal mold is also increased, and a heavy investment must be made in the mold. The demand for such a large outdoor unit is lower than that of a small outdoor unit, and its price tends to rise considerably to recover investment funds.

Under such circumstances, an outdoor unit of an air-conditioner which can have a large air-conditioning capacity by an investment in a small-size mold has been desired.

In general, according to one embodiment, an outdoor unit of an air conditioner includes: an outdoor heat exchanger, an air-blower assembly including an air exchanger, and a housing accommodating the outdoor heat exchanger and the air-blower assembly. The outdoor heat exchanger, the air-blower assembly and the housing, and another outdoor heat exchanger, another air-blower assembly and another housing are configured to be stackable on each other in a vertical direction.

An embodiment will be described hereinafter with reference to the accompanying drawings. Outdoor units of an air conditioner described hereinafter are "single-stage outdoor unit", "two-stage outdoor unit" and "three-stage outdoor unit", from which a selection is made and is provided in accordance with a required maximum air-conditioning capacity. In particular, the overall height dimension of "three-stage outdoor unit" is about 1800 mm, and is substantially the maximum size than can be accommodated in a freight elevator.

Although "four-stage outdoor unit" and a larger outdoor unit can be manufactured in theory, problems may arise in carrying and installing such a unit. It is impractical as the type of outdoor unit disposed on respective floors of, for example, a condominium, and thus, explanations thereof will be omitted here.

First, a single-stage outdoor unit 1M applied to an air conditioner of small capacity for which a required maximum air-conditioning capacity is up to about 2 horsepower (2 hp).

Figure 1A:
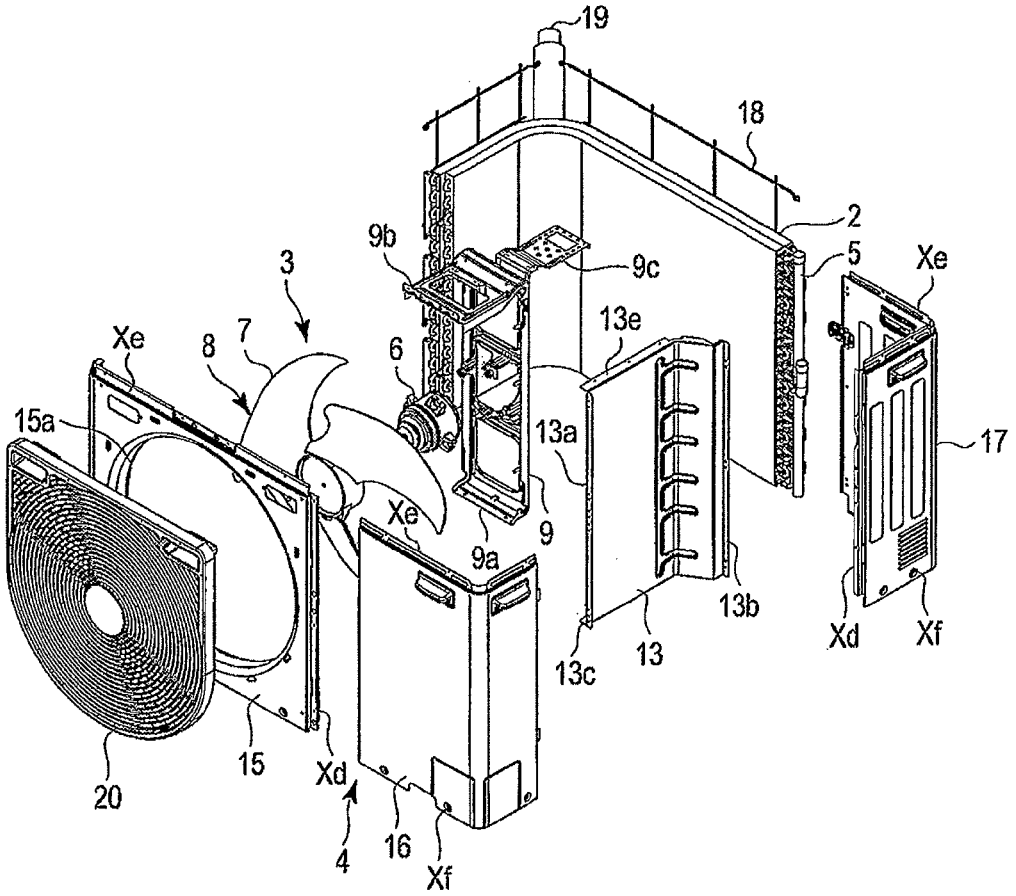
FIG. 1A is a perspective view showing main component parts into which a single-stage outdoor unit is disassembled according to a present embodiment.
Figure 1B:
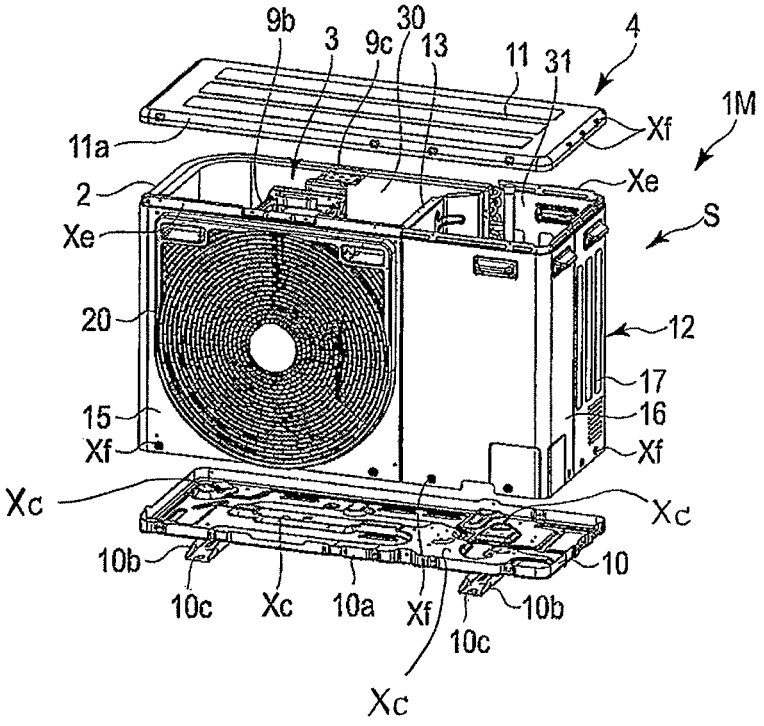
FIG. 1B is a perspective view of the single-stage outdoor unit with which a base plate and a top plate are combined after assembling the main component parts of the single-stage outdoor unit according to the embodiment.
Figure 2A:
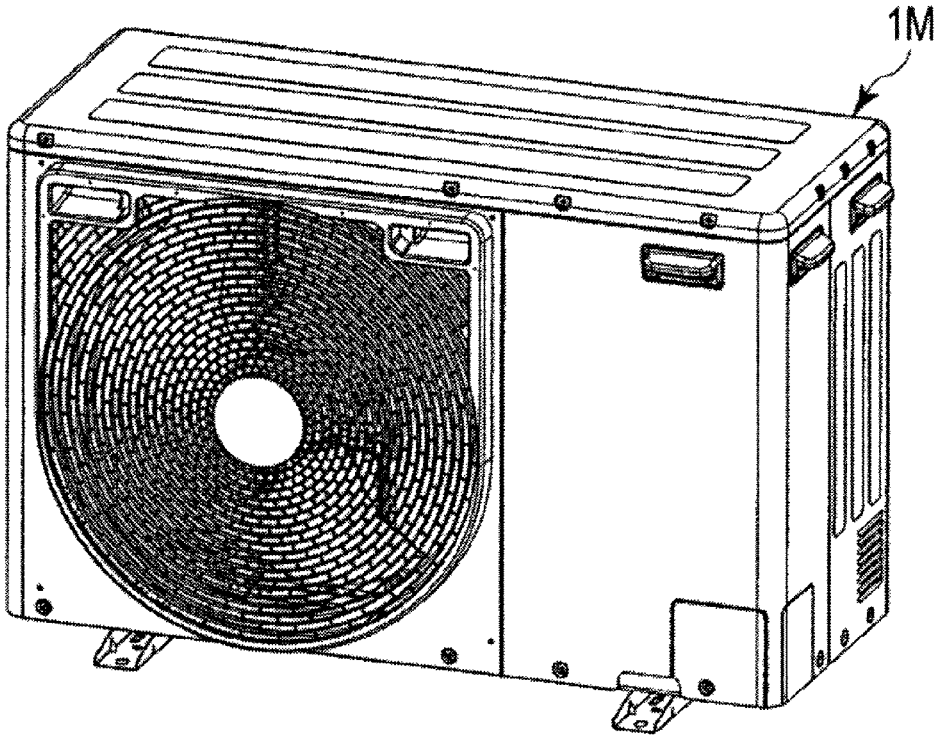
FIG. 2A is a perspective view showing the assembled single-stage outdoor unit according to the embodiment.
Figure 2B:
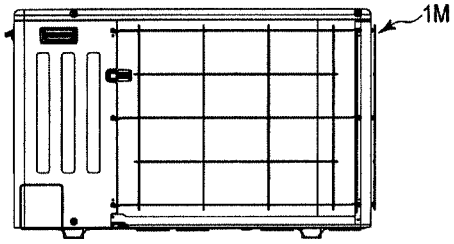
FIG. 2B is a back view showing the assembled single-stage outdoor unit according to the embodiment.
Figure 2C:
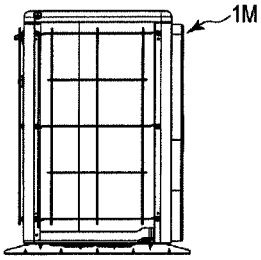
FIG. 2C is a left side view showing the assembled single-stage outdoor unit according to the embodiment.

FIG. 1A is a perspective view showing main component parts of the single-stage outdoor unit 1M in a disassembled manner. FIG. 1B is a perspective view of the single-stage outdoor unit 1M disassembled into a main component parts assembly S, a base plate 10 and a top plate 11. FIG. 2A is an external perspective view of the assembled single-stage outdoor unit 1M. FIG. 2B is a back view of the single-stage outdoor unit 1M. FIG. 2C is a left side view of the single-stage outdoor unit 1M.

The single-stage outdoor unit 1M of small capacity is composed of a heat exchanger 2, an air-blower assembly 3 and a housing 4.

As shown in FIG. 1A, the heat exchanger 2 is a fin tube type formed in substantially an L-shape in a planer view. Along one side thereof, a U-bend of a heat exchanger pipe projects, and along the other side, a U-bend, a distributing pipe and a collecting pipe 5 are provided. Additionally, the collecting pipe 5 is connected to refrigerating cycle component parts such as a compressor and an expansion valve through a pipe not shown in the figures.

The air-blower assembly 3 is comprised of an air blower 8 composed of a fan motor 6 and a fan 7 attached to a rotation axis of the fan motor 6, and an air-blower support frame 9 supporting the air blower 8. The air-blower support frame 9 is a frame long in a vertical direction, and the fan motor 6 is supported by a substantially central portion. A lower end of the air-blower support frame 9 is provided with a base-plate attachment portion 9*a* bent in substantially an L-shape, and an upper end is provided with a front-plate attachment portion 9*b* bent forward and a heat-exchanger support portion 9*c* bent toward a back side.

The housing 4 is comprised of a base plate 10 forming a base portion, a top plate 11 forming a ceiling portion, a side portion 12 located between the base plate 10 and the top plate 11, and a partition plate 13 partitioning the inside of the housing 4 into a heat exchange compartment 30 and a machine compartment 31. In the heat exchange compartment 30, the outdoor heat exchanger 2 and the air-blower assembly 3 are accommodated, and in the machine compartment 31, a compressor, a pipe, etc., are accommodated.

The base plate 10 has a rectangular shape in a planar view, and along its periphery, a folded portion 10*a* is provided. To an underside of the base plate 10, two support legs 10*b* are attached in parallel in a width direction of the housing 4, and attachment portions 10*c* project from four corners of the base plate 10. Into these attachment portions 10*c*, fixtures, for example, anchor bolts, provided in advance at an installation location are inserted, and the single-stage outdoor unit 1M can be fixed to the installation location through nuts, etc.

Moreover, on the base plate 10, a projection Xc for positioning the outdoor heat exchanger 2, a projection Xc for positioning the air-blower support frame 9, a projection Xc for positioning the partition plate 13, a projection Xc for positioning a compressor communicating with the outdoor heat exchanger 2 through a pipe, and the like are integrally provided. All the projection heights of these projections Xc are the same.

The top plate 11 has the same rectangular shape as that of the base plate 10 in a planar view, and a projection for holding rigidity is provided at a plane portion. Along its periphery, a folded portion 11*a* is provided, and at its side portion, hook depressions Xf for inserting, attaching and fixing a fixture is provided.

The side portion 12 is composed of a front plate 15 forming a front of the housing 4, a side front plate 16 forming the front and a part of a right side of the housing 4, a side back plate 17 forming a part of the right side and a part of a back of the housing 4, a fin guard 18 forming a part of the back and a left side of the housing 4, and a supporting column 19 forming a corner portion of the left side and the back of the housing 4.

At side edge portions facing each other of the front plate 15, the side front plate 16 and the side back plate 17, connection portions Xd for coupling them to each other are provided, and at upper ends thereof, connection portions Xe into which the top plate 11 is fitted are provided. At a lower end of the side portion 12, a hook depression Xf for inserting and fixing a fixture in a state of being fitted into the base plate 10 is provided.

On the front plate 15, a bell mouth 15*a* is integrally provided at a position facing a front of the air-blower fan 7 in a state of being assembled as the housing 4. To cover this bell mouth 15*a*, a fan guard 20 having a straight upper edge and straight left and right side edges and a circular lower edge is detachably attached.

In practice, when inserting fixtures such as anchor bolts into the attachment portions 10*c* of the support legs 10*b* and fastening nuts, etc., to fix the single-stage outdoor unit 1M to an installation location, the fan guard 20 cannot be obstructive at the time of installation work, because the fan guard 20 has the shape of a semicircle.

The fin guard 18 is made up by combining longitudinal and lateral wiry things, and is located at a position facing the outdoor heat exchanger 2 in a state of being assembled as the housing 4. Through the supporting column 19, one side portion of the fin guard 18 is attached to the front plate 15 and the other side portion is attached to the side back plate 17.

The partition plate 13 is provided with a front folded portion 13*a* along its front, a back folded portion 13*b* along its back, a lower-end connection portion 13*c* along its lower end, and an upper-end connection portion 13*e* along its upper end.

The outdoor heat exchanger 2 composed in this manner, a portion of the air-blower support frame 9 from the base-plate attachment portion 9*a* to the heat-exchanger support portion 9*c* at an upper portion, and the partition plate 13 are set at the same height dimension as each other. Thus, when the outdoor heat exchanger 2, the air-blower support frame 9 and the partition plate 13 are placed on the projections Xc of the base plate 10 composing the housing 4, the height positions of their upper ends are the same as each other.

In addition, in a state of being assembled by fitting the side portion 12 composed of the front plate 15, the side front plate 16 and the side back plate 17 into the folded portion 10*a* of the base plate 10, a base portion of the base plate 10 and a lower end of the above side portion 12 are configured to all correspond to each other.

At upper ends of the front plate 15, the side front plate 16, and the side back plate 17, the connection portions Xe are provided, and the height dimensions of these connection portions Xe and the height dimensions of the projections Xc provided on the base plate 10 correspond to each other. In addition, the height positions of lower ends of the connection portions Xe, and respective upper ends of the outdoor heat exchanger 2 located on the base plate 10, the heat-exchanger support portion 9*c* of the air-blower support frame 9 and the partition plate 13 are configured to all correspond to each other.

FIG. 1B shows a state in which the base plate 10 and the top plate 11 are assembled toward the main component parts assembly S, but in practice, assembly is carried out as will be hereinafter described.

First, a compressor is disposed on the base plate 10 and is attached and fixed through a fixture such as a screw. On the projections Xc formed on the base plate 10, the outdoor heat exchanger 2, the air-blower support frame 9 of the air-blower assembly 3 are attached in order through a fixture. Here, the heat-exchanger support portion 9*c* provided at the air-blower support frame 9 is hooked to a part of an upper end of the outdoor heat exchanger 2.

Next, the compressor, the distributing pipe and the collecting pipe 5 connected to the outdoor heat exchanger 2, a four-way valve not shown in the figure, etc., are connected through a refrigerant pipe by brazing processing. Then, the partition plate 13 is attached on the projections Xc of the base plate 10 through a fixture, the back folded portion 13*b* is attached to an end plate not shown in the figures of the outdoor heat exchanger 2 through a fixture.

Furthermore, the fan motor 6 is attached to the air-blower support frame 9, and the fan 7 is attached to the rotation axis of the fan motor 6. Then, an electrical parts box (not shown in the figure) accommodating a control board, etc., configured to drive the compressor, the fan motor 6, the four-valve, etc., is disposed in an upper portion of the machine compartment 31, and to this electrical parts box, wires such as signal wires of various sensors and power wires of the compressor and the fan motor 6 are connected.

Next, to the folded portion 10*a* of the base plate 10, the lower end of the front plate 15 composing the side portion 12 is attached through a fixture. To a part of the upper end of this front plate 15, the front-plate attachment portion 9*b* of the air-blower support frame 9 is hooked, and is attached through a fixture.

Because only the front-plate attachment portion 9*b* is formed more depressed than the other portions, it cannot be obstructive when the top plate 11 is attached later. The front folded portion 13*c* of the partition plate 13 is attached to the front plate 15 through a fixture. To the front plate 15, the fan guard 20 is attached.

Next, the lower end of the side back plate 17 is attached to the folded portion 10*a* of the base plate 10, and the top plate 11 is fitted into the connection portions Xe of the upper ends of the front plate 15 and the side back plate 17. To a corner portion of the left side and the back of the housing 4, the supporting column 19 is attached between the base plate 10 and the top plate 11. Through this supporting column 19, the fin guard 18 is attached to the front plate 15 and the side back plate 17.

Finally, the side front plate 16 is disposed between the front plate 15 and the side back plate 17, facing side edge portions are combined, the connection portion Xe at the upper end of the side front plate 16 is fitted into the top plate 11, and the lower end of the side front plate 16 is attached to the folded portion 10*a* of the base plate 10 through a fixture.

In the above manner, the single-stage outdoor unit 1M is completed.

Based on the above-described dimensional settings, in the state of the main component parts assembly S, the positions of the lower end edges of the front plate 15, the side front plate 16 and the side back plate 17 composing the housing side portion 12 all correspond to each other, and the height positions of the lower end edges of the connection portions Xe on the upper ends, and the upper end edges of the outdoor heat exchanger 2, the heat-exchanger support portion 9*c* of the air-blower support frame 9, and the partition plate 13 all correspond to each other.

In addition, the dimensions of the projections Xc of the base portion 10 supporting a lower end of the outdoor heat exchanger 2, the base-plate attachment portion 9*a* of the air-blower support frame 9 and a lower end of the partition plate 13, and the height dimensions of the connection portions Xe of the front plate 15, the side front plate 16 and the side back plate 17 composing the housing side portion 12 correspond to each other.

Thus, as shown in FIG. 2A, FIG. 2B and FIG. 2C, the single-stage outdoor unit 1M is assembled. In a state where the top plate 11 covers and is attached to the component parts composed of the outdoor heat exchanger 2, the air-blower support frame 9, the side portion 12, the partition plate 13, etc., there is no room for occurrence of a gap between each of the component parts and the top plate 11, and assembly is surely carried out.

Also, there is a case of an outdoor unit of an air conditioner for which a required maximum air-conditioning capacity is, for example, 3 horsepower (3 hp), which is 1.5 times to twice that of the single-stage outdoor unit 1M. To meet such a requirement, "deformed single-stage outdoor unit" in which a compressor having a greater capacity than that of the compressor used in the single-stage outdoor unit 1M is used and the dimensions of components parts are changed (only the vertical dimensions are enlarged) can be applied.

Also in this deformed single-stage outdoor unit, the condition that the components parts composed of the outdoor heat exchanger 2, the air-blower support frame 9, the side portion 12, the partition plate 13, etc., are set at the same height dimension as each other is not changed at all as in the above-described single-stage outdoor unit 1M.

Therefore, in the case of the deformed single-stage outdoor unit, the sizes of metal molds for manufacturing component parts can be obtained by increasing somewhat the dimensions of metal molds of the single-stage outdoor unit 1M, and the deformed single-stage outdoor unit can be commercialized by a relatively small investment.

Next, an outdoor unit of an air conditioner for which a required maximum air-conditioning capacity is 5 horsepower (5 hp) to 6 horsepower (6 hp), which is 2.5 to 3 times that of the above-described single-stage outdoor unit 1M, that is, a two-stage outdoor unit 2M, will be described.

Figure 3:
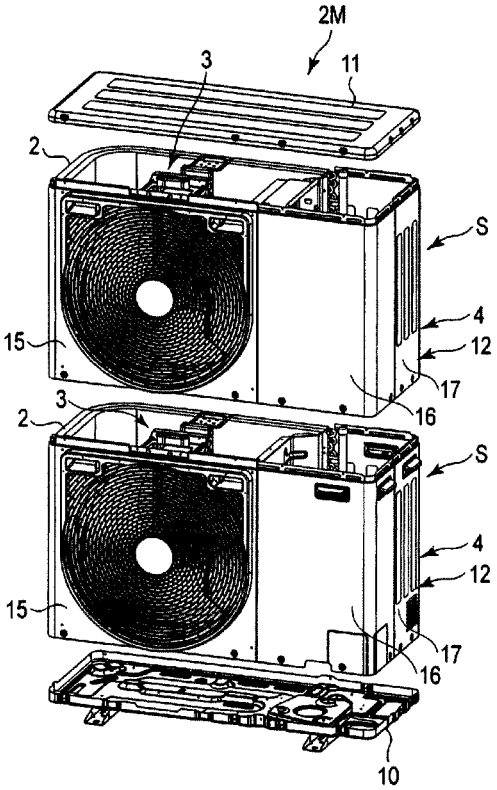
FIG. 3 is a perspective view showing a two-stage outdoor unit with which a base plate and a top plate are combined after assembling main component parts according to the embodiment.
Figure 4:
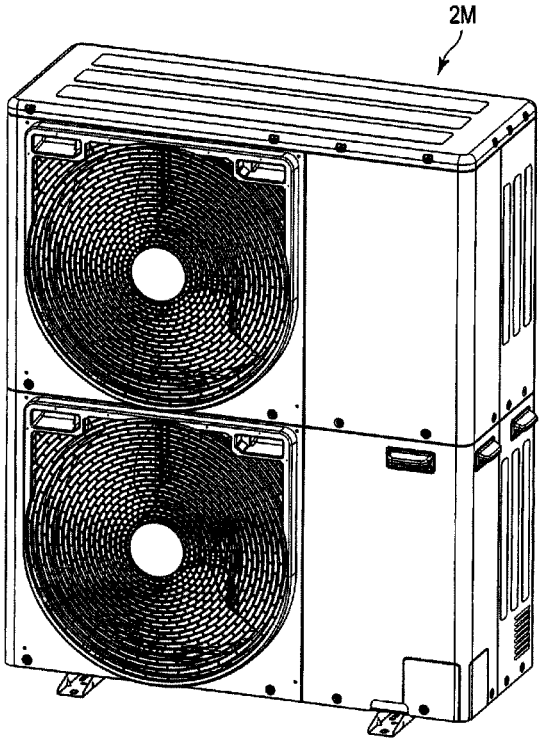
FIG. 4 is a perspective view showing the assembled two-stage outdoor unit according to the embodiment.

FIG. 3 is a perspective view showing the two-stage outdoor unit 2M in a divided manner. FIG. 4 is an external perspective view of the assembled two-stage outdoor unit 2M.

The two-stage outdoor unit 2M is composed in a state where two heat exchangers 2, two air-blower assemblies 3 including air blowers and two housings 4 are stacked on each other in a vertical direction. Although two side portions 12 composing the housings 4, are needed, it suffices that there are one base plate 10 and one top plate 11.

That is, as shown in FIG. 3, two main component parts assemblies S, each explained above with reference to FIG. 1B, are stacked on the base plate 10 in a vertical direction, and an upper end is crowned with a top plate 11.

In practice, on the base plate 10, a compressor is disposed and an outdoor heat exchanger 2 and an air-blower support frame 9 are attached. Then, another outdoor heat exchanger 2 and another air-blower support frame 9 are stacked on the respective parts.

A necessary pipe, etc., are incorporated between the compressor and the two outdoor heat exchangers 2, and are connected by brazing processing. Then, a partition plate 13 is attached on the base plate 10, and another partition plate 13 is attached thereon. Fan motors 6 are attached to the respective air-blower support frames 9, and fans 7 are attached to the respective fan motors 6.

Next, an electrical parts box is disposed in a machine compartment 31 on an upper stage side, and to this electrical parts box, wires such as signal wires of various sensors and power wires of the compressor and the fan motors 6 are connected. A front plate 15 of the lower stage is attached, and a front plate 15 of the upper stage is attached thereon.

In addition, fan guards 20 are attached to the respective upper and lower front plates 15.

Next, a side back plate 17 of the lower stage is attached, and a side back plate 17 of the upper stage is attached thereon. In this state, the top plate 11 is fitted into connection portions Xe at upper ends of the front plate 15 of the upper stage and the side back plate 17 of the upper stage.

At a corner portion of a left side and a back portion of the housings 4, a supporting column 19 is attached between the base plate 10 and the top plate 11. The supporting column 19 used herein has a length dimension of twice that of the supporting column 19 used in the above-described single-stage outdoor unit 1M. Through this supporting column 19, two pairs of fin guards 18 (both of which are not shown in the figures) are attached to the front plates 15 and the side back plates 17.

Next, a side front plate 16 of the upper stage is disposed between the front plate 15 and the side back plate 17 of the upper stage, and a connection portion Xe at an upper end of the side front plate 16 of the upper stage is fitted into the top plate 11, and is attached through a fixture. Finally, a side front plate 16 of the lower stage is disposed between the front plate 15 of the lower stage and the side back plate 17 of the lower stage, a connection portion Xe at an upper end of the side front plate 16 of the lower stage is fitted into the lower end of the side front plate 16 of the upper stage, and a lower end of the side front plate 16 of the lower stage is attached to a folded portion 10*a* of the base plate 10 through a fixture.

In the above manner, the two-stage outdoor unit 2M is completed.

If a required maximum air-conditioning capacity is, for example, 8 horsepower (8 hp) to 10 horsepower (10 hp), which is 4 to 5 times that of the single-stage outdoor unit 1M, it suffices that "mixed two-stage outdoor unit" into which a deformed outdoor unit and a single-stage outdoor unit 1M, each described above, are combined is used, or that "deformed two-stage outdoor unit" in which two deformed single-stage outdoor units are combined is used.

In each of the above cases, because outdoor heat exchangers 2, air-blower assemblies 3 and housings 4 are configured to be stackable in a vertical direction, a large-size (two-stage) outdoor unit can be composed of parts manufactured with small-size facilities and small-size molds.

Joints of the respective component parts stacked in a vertical direction are at the same height position. At the joints of the respective component parts, there is no room for occurrence of a gap. Thus, other parts for dimension adjustment are not needed, and reduction in cost can be made without trouble.

Because the outdoor heat exchangers 2, the air-blower assemblies 3 and the housings 4 are set in the same shape as each other in a vertical direction, the two-stage outdoor unit 2M, which is an outdoor unit of a two-stage size, can be manufactured merely by investment in molds for manufacturing component parts for one stage. Alternatively, by further adding investment in molds for manufacturing component parts for one stage of a deformed single-stage outdoor unit, a mixed two-stage outdoor unit or a deformed two-stage outdoor unit can be manufactured.

Next, an outdoor unit of an air conditioner for which a required maximum air-conditioning capacity is 10 horsepower to 12 horsepower (10 to 12 hp), which is 5 to 6 times that of the single-stage outdoor unit 1M, that is, a three-stage outdoor unit 3M, will be described.

Figure 5:
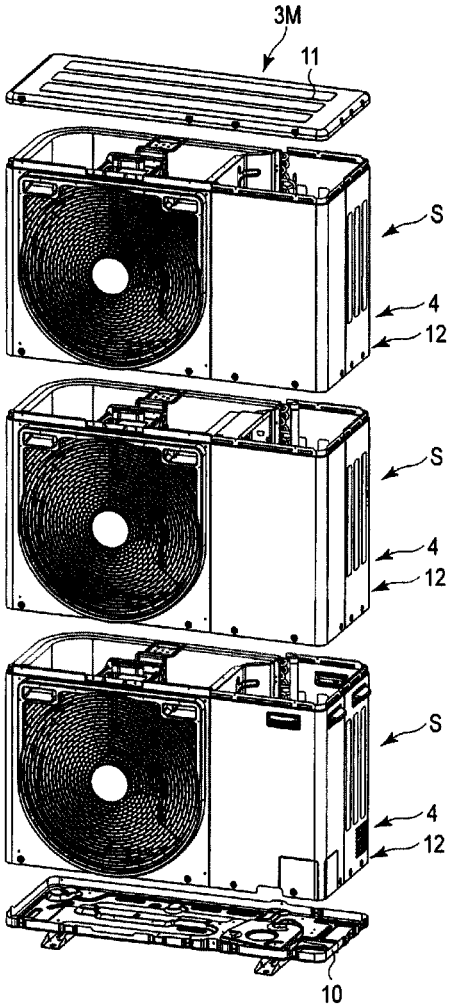
FIG. 5 is a perspective view showing a three-stage outdoor unit with which a base plate and a top plate are combined after assembling main component parts according to the embodiment.
Figure 6:
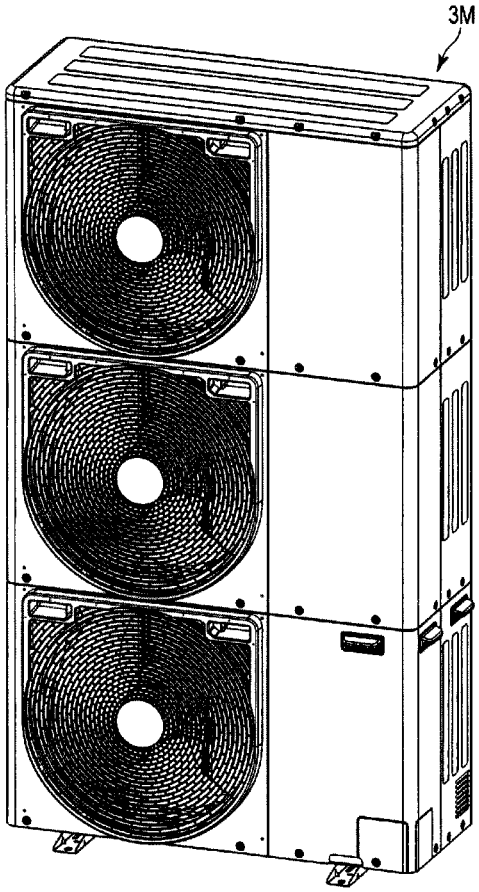
FIG. 6 is a perspective view showing the assembled three-stage outdoor unit according to the embodiment.
Figure 7A:
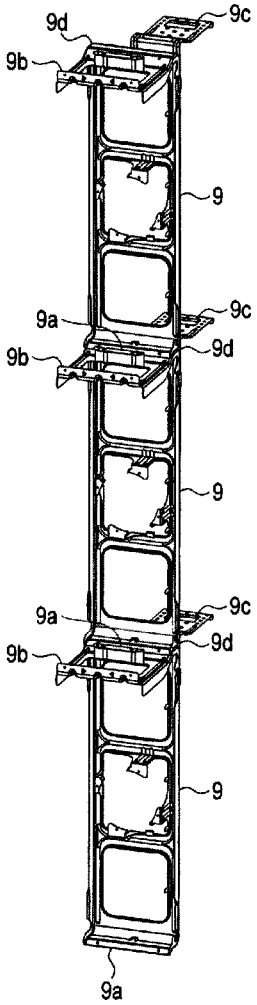
FIG. 7A is a perspective view showing an air-blower support frame used in the three-stage outdoor unit according to the embodiment.
Figure 7B:
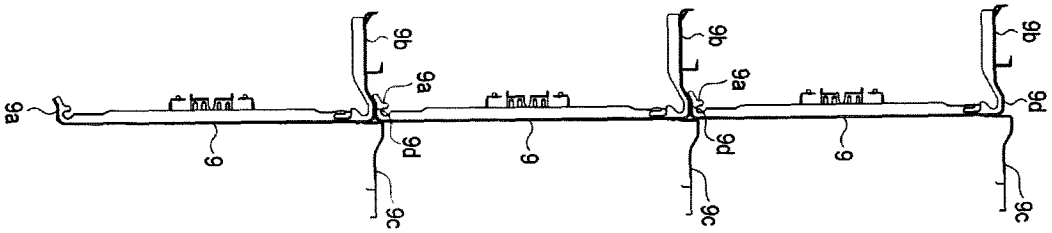
FIG. 7B is a side view showing the air-blower support frame used in the three-stage outdoor unit according to the embodiment.

FIG. 5 is a perspective view showing the three-stage outdoor unit in a divided manner. FIG. 6 is an external perspective view of the assembled three-stage outdoor unit. FIG. 7A is a perspective view showing a state where three air-blower support frames 9 are assembled, and FIG. 7B is a side view of FIG. 7A.

The three-stage outdoor unit 3M is composed in a state where three heat exchangers 2, three air-blower assemblies 3 including air blowers, three housings 4 are stacked on each other in a vertical direction. However, although three side portions 12 composing the housings 4 are needed, it suffices that there are one base plate 10 and one top plate 11.

As shown in FIG. 5, three main component parts assemblies S, each described above with reference to FIG. 1B, are stacked on the base plate 10 in a vertical direction, and an upper end is crowned with the top plate 11. Thus, the three-stage outdoor unit 3M shown in FIG. 6 is completed.

In practice, each of the component parts are assembled as will be hereinafter described.

First, on the base plate 10, a compressor 21 and a gas-liquid separator 22 are disposed, and are fixed through fixtures. Next, an air-blower support frame 9 to be at the bottom stage is placed on a projection Xc provided at a predetermined place on the base plate 10, and is attached and fixed through a fixture such as a screw.

Moreover, one outdoor heat exchanger 2 is prepared and is placed on a projection Xc along one side and the back of the base plate 10, which is a predetermined place on the base plate 10. A part of the upper end along a back side of the outdoor heat exchanger 2 is hooked to a heat-exchanger support portion 9*c* provided in a projecting manner at the air-blower support frame 9 of the bottom stage.

Next, another air-blower support frame 9 is prepared and is stacked on the air-blower support frame 9 of the bottom stage as an air-blower support frame 9 of the middle stage. More specifically, on an upper-portion attachment portion 9*d* provided between a front-plate attachment portion 9*b* and the heat-exchanger support portion 9*c* formed at the upper end of the air-blower support frame 9 of the bottom stage, a base-plate attachment portion 9*a* of the air-blower support frame 9 of the middle stage is placed, and is fixed by means of, for example, a screw.

This upper-portion attachment portion 9*d* has the same projecting shape as those of the projections Xc of the base plate 10, and the base-plate attachment portion 9*a* of the air-blower support frame 9 of the middle stage can be surely positioned.

Furthermore, another outdoor heat exchanger 2 is stacked on the bottom-stage outdoor heat exchanger 2A which has already been placed on the base plate 10, as a middle-stage outdoor heat exchanger 2B. A lower end of this middle-stage outdoor heat exchanger 2B interposes the heat-exchanger support portion 9*c* of the bottom-stage air-blower support frame 9A between itself and the bottom-stage outdoor heat exchanger 2A, and an upper end is hooked to a heat-exchanger support portion 9*c* of the middle-stage air-blower support frame 9B.

Next, another air-blower support frame 9 is stacked on the middle-stage air-blower support frame 9 as an air-blower support frame 9 of the top stage. More specifically, at an upper-portion attachment portion 9*d* formed on an upper portion of the air-blower support frame 9 of the middle stage, a base-plate attachment portion 9*a* of the air-blower support frame 9 of the top stage is placed and positioned, and is fixed by means of, for example, a screw.

In addition, another outdoor heat exchanger 2 is prepared and is stacked on the middle-stage outdoor heat exchanger 2B as a top-stage outdoor heat exchanger 2C. A lower end of this top-stage outdoor heat exchanger 2C interposes the heat-exchanger support portion 9*c* of the middle-stage air-blower support frame 9B between itself and the middle-stage outdoor heat exchanger 2B, and an upper end is hooked to a heat-exchanger support portion 9*c* of the top-stage air-blower support frame 9C.

By placing the three heat exchangers 2 in this manner, collecting pipes 5 on the sides of the respective heat exchangers 2 are brought into contact with each other, and thus, these are integrally connected by brazing processing, etc. The state to this point is shown in FIG. 8A.

Figure 8A:
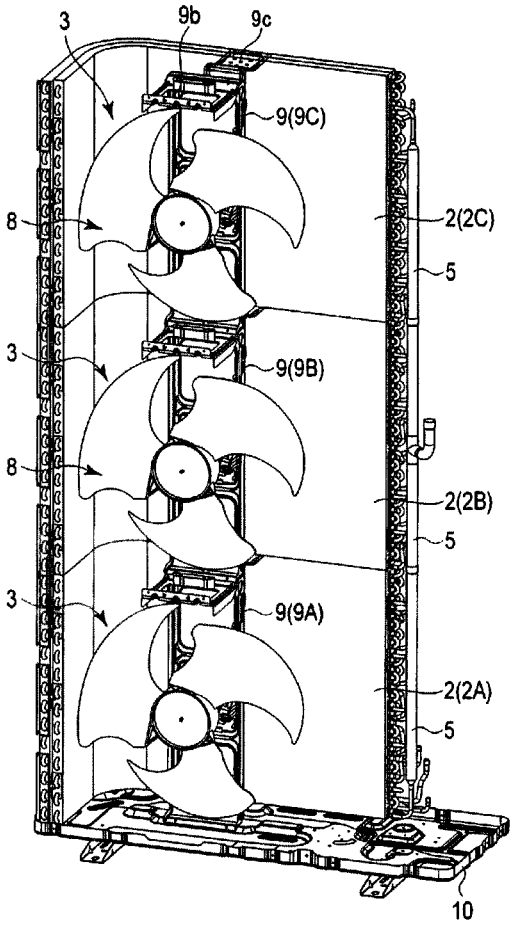
FIG. 8A is a perspective view showing the three heat exchangers of the three-stage outdoor unit according to the embodiment.
Figure 8B:
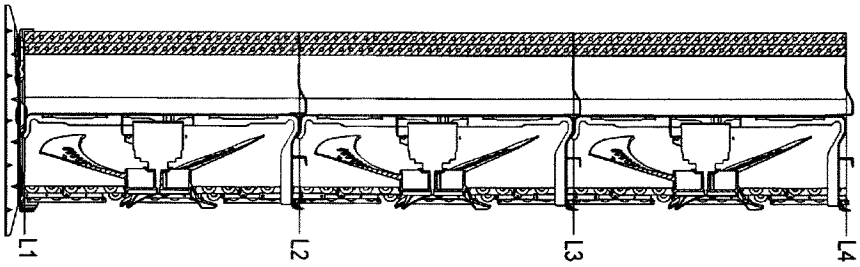
FIG. 8B is a longitudinal sectional view of FIG. 8A.

Further, a longitudinal sectional view of FIG. 8A is shown in FIG. 8B. As shown in FIG. 8B, a lower end of the bottom-stage outdoor heat exchanger 2A and an underside of the base-plate attachment portion 9*a* in the air-blower support frame 9 of the bottom stage are placed on the projections Xc of the base plate 10, and thus are the same in height (L1 in the figure).

In addition, the upper end of the bottom-stage outdoor heat exchanger 2A, and the upper ends of the heat-exchanger support portion 9*c* and the upper-portion attachment portion 9*d* of the bottom-stage air-blower support frame 9A are also the same in height (L2 in the figure). Similarly, the upper end of the middle-stage outdoor heat exchanger 2B, and the upper ends of the heat-exchanger support portion 9*c* and the upper-portion attachment portion 9*d* of the middle-stage heat-exchanger support frame 9 are also the same in height (L3 in the figure).

Moreover, the upper end of the top-stage outdoor heat exchanger 2C, and the upper ends of the heat-exchanger support portion 9*c* and the upper-portion attachment portion 9*d* of the top-stage heat-exchanger support frame 9 are also the same in height (L4 in the figure). In addition, all the dimensions between L1 and L2, between L2 and L3, and between L3 and L4 are the same.

Figure 9:
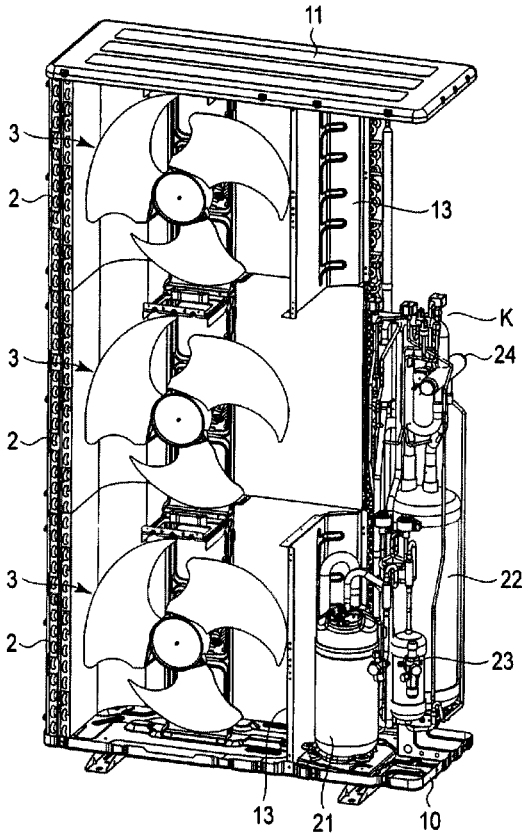
FIG. 9 is a perspective view showing the three heat exchangers and the compressor of the three-stage outdoor unit according to the embodiment.

FIG. 9 is a perspective view of the three-stage outdoor unit 3M on the way of being further assembled. From the state of FIG. 8A, the compressor 21, the gas-liquid separator 22, an oil separator 23, a four-way valve 24, a distributing pipe and a collecting pipe 5 are connected through a pipe K by brazing processing.

At this time, refrigerating cycle parts such as the pipe K and the compressor 21 are accommodated in spaces corresponding to machine compartments 31 of the two stages of the bottom stage and the middle stage. In a space corresponding to a machine compartment 31 of the top stage, only the distributing pipe and the collecting pipe 5 connected to the top-stage heat exchanger 2C are provided, and the refrigerating cycle parts such as the pipe K and the compressor 21 are not provided.

Next, a partition plate 13 to be at the bottom stage is attached to a predetermined place of the base plate 10. To an upper portion of this partition plate 13, an electrical parts box H is attached.

Figure 10:
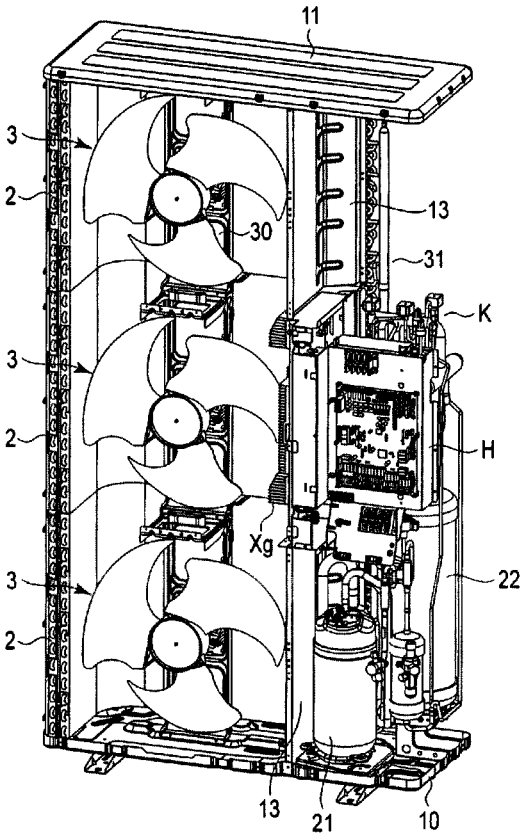
FIG. 10 is a perspective view showing the three heat exchangers, the compressor and the electrical parts box of the three-stage outdoor unit according to the embodiment.

FIG. 10 is a perspective view showing a state where the electrical parts box H is attached in FIG. 9. In the electrical parts box H, drive control parts configured to electrically control air blowers 8, the compressor 21, etc., and signal control parts configured to control various signals are accommodated.

The electrical parts box H is formed integrally with a partition plate 13 to be at the middle stage, and makes a partition into a heat exchange compartment 30 and a machine compartment 31, but a part thereof projects to the heat exchange compartment 30. This projection is a heat sink Xg for cooling heavy-current parts apt to produce heat, such as a power module of an inverter configured to drive the compressor 21 and the air blowers 8.

To an upper portion of this electrical parts box H, a partition plate 13 to be at the top stage is attached. Next, fan motors 6 are attached to the three air-blower support frames 9, respectively, and fans 7 are attached to the fan motors 6. The air-blower assemblies 3 are thereby completed. In this state, signal wires of various sensors and power wires of the compressor 21 and the air blowers 8 are connected to the electrical parts box H.

Next, a front plate 15 to be at the bottom stage is attached, a front plate 15 to be at the middle stage is attached thereon, and a front plate 15 to be at the top stage is attached thereon. In addition, fan guards 20 are attached to these respective front plates 15.

Furthermore, a side back plate 17 to be at the bottom stage is attached, a side back plate 17 to be at the middle stage is attached thereon, a side back plate 17 to be at the top stage is attached thereon. In addition, the top plate 11 is fitted into connection portions Xe of upper ends of the front plate 15 of the top stage and the side back plate 17 of the top stage.

Next, to a corner portion of a left side and a back portion of the housings 4, a supporting column 19 is attached between the base plate 10 and the top plate 11. The supporting column 19 used herein has a length dimension of three times that of the supporting column 19 used in the above-described single-stage outdoor unit 1M. Through this supporting column 19, three pairs of fin guards 18 are attached to the front plates 15 and the side back plates 17 in a vertical direction.

Moreover, a side front plate 16 to be at the top stage is disposed between the front plate 15 and the side back plate 17 of the top stage, and a connection portion Xe at an upper end of the side front plate 16 is fitted into the top plate 11 and is attached through a fixture. Below this side front plate 16 of the top stage, a side front plate 16 to be at the middle stage is disposed, and a connection portion Xe at an upper end of the side front plate 16 of the middle stage is fitted into a lower end of the side front plate 16 of the top stage and is attached through a fixture.

Finally, below the side front plate 16 of the middle stage, a side front plate 16 to be at the bottom stage is disposed, and a connection portion Xe of an upper end of the side front plate 16 of the bottom stage is fitted into a lower end of the side front plate 16 of the middle stage and is attached though a fixture. In addition, a lower end of the side front plate 16 of the bottom stage is attached to a folded portion 10*a* of the base plate 10 through a fixture.

In the above manner, the three-stage outdoor unit 3M described above with reference to FIG. 6 is completed.

Hereinafter, a connection structure in a vertical direction of the side portions 12 composing the housings 4 will be described with examples of the side back plates 17.

Figure 11A:
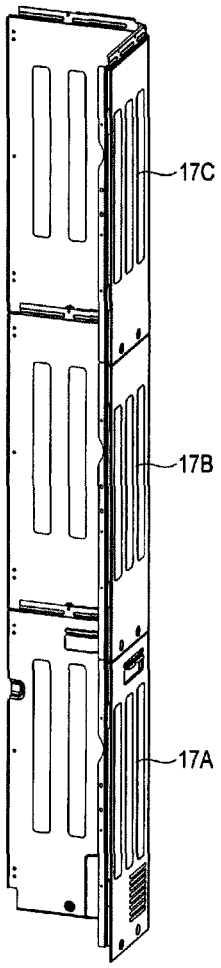
FIG. 11A is an illustration showing a perspective view of a side back plate used in the three-stage outdoor unit according to the embodiment.
Figure 11B:
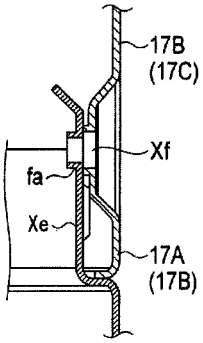
FIG. 11B is an illustration showing a coupling structure of upper and lower side back plates used in the three-stage outdoor unit according to the embodiment.

FIG. 11A is an illustration showing the state where the three side back plates 17 forming the right side and the back of the housings 4 are integrated. FIG. 11B is a coupling structural view of upper and lower side back plates 17. In the case of the side back plates 17, into a connection portion Xe formed at an upper end of the bottom-stage side back plate 17A, a lower end of the middle-stage side back plate 17B is fitted.

At this time, as shown in FIG. 11B, a hole portion fa provided at the connection portion Xe of the bottom-stage side back plate 17A faces a hook depression Xf provided at the lower end of the middle-stage side back plate 17B. Thus, by inserting and fixing a fixture not shown in the figures into the hook depression Xf and the hole portion fa, the bottom-stage side back plate 17A and the middle-stage side back plate 17B are mutually coupled and fixed.

Similarly, into a connection portion Xe formed at an upper end of the middle-stage side back plate 17B, a lower end of the top-stage side back plate 17C is fitted. At this time, a hole portion fa provided at the connection portion Xe of the middle-stage side back plate 17B faces a hook depression Xf provided at the lower end of the top-stage side back plate 17C, and thus they are coupled and fixed through a fixture. In this manner, the three side back plates 17 are coupled.

In the above description, although the connection structure in a vertical direction of the side portions 12 composing the housings 4 has been described with the examples of the side back plates 17, the front plates 15 and the side front plates 16 are also coupled in the same structure as that of the side back plates 17. However, the side front plates 16 are different from the front plates 15 and the side back plates 17 in that they are coupled in the order of the top stage, the middle stage, and the bottom stage.

Also in this three-stage outdoor unit 3M, the outdoor heat exchangers 2, the air-blower assemblies 3 and the housings 4 are configured to be stackable in a vertical direction, and thus, a large-size (three-stage) outdoor unit can be composed of parts manufactured with small-size facilities and small-size molds.

Because the joints of the respective component parts stacked in a vertical direction are at the same height position, there is no room for occurrence of a gap at the joints of the respective component parts. Thus, other parts for dimension adjustment are not needed, and reduction in cost can be made without trouble.

Because all of the outdoor heat exchangers 2, the air-blower assemblies 3 and the housings 4 are set in the same shape in a vertical direction, the three-stage outdoor unit 3M, which is an outdoor unit of a three-stage size, can be manufactured merely by investment in models for manufacturing component parts for one stage.

In the above-described three-stage outdoor unit 3M, the electrical parts box H is provided at the same position as that of the outdoor heat exchanger 2 of a second stage (middle stage), and the pipe K is provided over the outdoor heat exchanger 2 of a first stage (bottom stage) and the outdoor heat exchanger 2 of the second stage.

Thus, by removing the outdoor heat exchanger 2, the air-blower assembly 3 including the air blower 8 and the side portion 12 of the housing 4, of a third stage (top stage), the two-stage outdoor unit 2M described above with reference to FIG. 3 and FIG. 4 can be obtained.

Moreover, in a newly developed model, if more piping spaces are needed, the piping spaces can be easily secured by moving an electrical parts box to a third stage. In this manner, convenience in design is increased by modularization.

Figure 12:
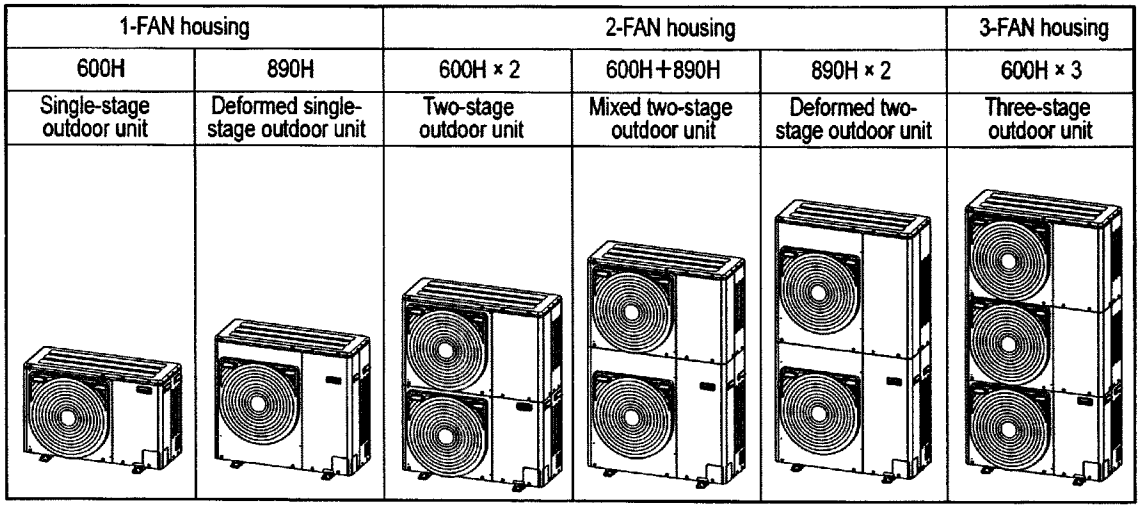
FIG. 12 is a lineup structural view of the various outdoor units according to the embodiment.

FIG. 12 is a lineup structural view of the various outdoor units.

A division is broadly made into three types: "1-fan housing" with one outdoor heat exchanger, one air blower and one housing; "2-fan housing" with two outdoor heat exchangers, two air blowers and two housings; and "3-fan housing" with three outdoor heat exchangers, three air blowers and three housings.

"Single-stage outdoor unit" having a reference maximum air-conditioning capacity of 2 hp is commercialized by an initial investment as the 1-fan housing. A housing height dimension H of this single-stage outdoor unit is 600 mm.

In addition, "deformed single-stage outdoor unit" which has been improved on the basis of the single-stage outdoor unit and has a maximum air-conditioning capacity of 3 or 4 hp is commercialized by a second investment. A housing height dimension H of this deformed single-stage outdoor unit is 890 mm.

"Two-stage outdoor unit" in which two single-stage outdoor units are stacked is commercialized as the 2-fan housing. "Mixed two-stage outdoor unit" in which a single-stage outdoor unit and a deformed single-stage outdoor unit are stacked is commercialized as the 2-fan housing. "Deformed two-stage outdoor unit" in which two deformed single-stage outdoor units are stacked is commercialized as the 2-fan housing.

The two-stage outdoor unit has a height dimension H of 600 mm×2 and a maximum air-conditioning capacity of 5 or 6 hp. The mixed outdoor unit has a height dimension H of 600+890 mm and a maximum air-conditioning capacity of 8 hp. The deformed two-stage outdoor unit has a height dimension H of 890 mm×2 and a maximum air-conditioning capacity of 10 hp.

"Three-stage outdoor unit" in which three single outdoor units are stacked is commercialized as the 3-fan housing. This three-stage outdoor unit has a height dimension H of 600 mm×3 and a maximum air-conditioning capacity of 10 or 12 hp.

In this manner, a lineup structure of a total of six types of outdoor units can be obtained on the basis of the single-stage outdoor unit 1M, and flexibility in design can be increased.

In both of the 2- and 3-fan housings, the respective component parts are stacked in a vertical direction, and thus, a large-size outdoor unit of an air conditioner according to a required maximum heat exchange capacity can be manufactured with parts manufactured with small-size facilities and small-size molds.

Even if component parts having different height dimensions in a vertical direction are stacked, a gap does not occur at the joints in a vertical direction in individual outdoor units. Thus, lines of parts of each of the outdoor units correspond with each other.

Since outdoor heat exchangers, air-blower assemblies, and housings are set in the same shape in a vertical direction, an outdoor unit composed of a plurality of stacked stages can be manufactured merely by investment for manufacturing one stage.

Since an outdoor heat exchanger 2, an air-blower assembly 3 and a housing 4 comprise connection portions (a hook depression Xf and a hole portion fa) which can be coupled to another outdoor heat exchanger 2, another air-blower assembly 3 and another housing 4 stacked in a vertical direction, they can be surely stacked.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

According to the present invention, an outdoor unit of an air conditioner which is basically composed of small-size component parts and can have a large air-conditioning capacity by stacking the small-size component parts in a vertical direction in accordance with a required air-conditioning capacity can be obtained.

What is claimed is:

1. An outdoor unit of an air conditioner comprising:

a base plate which forms a base portion of the outdoor unit;

a first housing attached onto the base plate;

a second housing stacked on the first housing; and a top plate which is attached onto the second housing and forms a ceiling portion of the outdoor unit, wherein the first housing includes:

a first side portion attached onto the base plate;

a first partition plate which is attached onto the base plate and divides a space surrounded by the first side portion into a first heat exchange compartment and a first machine compartment;

a first heat exchanger attached onto the base plate and accommodated in the first heat exchange compartment;

a first air blower accommodated in the first heat exchange compartment;

a first air-blower support frame which is attached onto the base plate and supports the first air blower and the first heat exchanger; and a compressor provided on the base plate and accommodated in the first machine compartment, and the first air-blower support frame includes:

a first base-plate attachment portion attached onto the base plate, at a lower end of the first air-blower support frame;

a first upper-portion attachment portion at an upper end of the first air-blower support frame; and a first blower attachment portion which supports the first-air blower at a position between the lower end of the first air-blower support frame and the upper end of the first air-blower support frame, and the second housing includes:

a second side portion stacked on the first side portion;

a second partition plate which is stacked on the first partition plate and divides a space surrounded by the second side portion into a second heat exchange compartment and a second machine compartment;

a second heat exchanger stacked on the first heat exchanger and accommodated in the second heat exchange compartment;

a second air blower accommodated in the second heat exchange compartment; and a second air-blower support frame which is stacked on the first air-blower support frame and supports the second air blower and the second heat exchanger, and the second air-blower support frame includes:

a second base-plate attachment portion attached onto the first upper-portion attachment portion of the first air-blower support frame, at a lower end of the second air-blower support frame;

a second upper-portion attachment portion at an upper end of the second air-blower support frame; and a second blower attachment portion which supports the second air-blower at a position between the lower end of the second air blower support frame and the upper end of the second air-blower support frame.

2. The outdoor unit of claim 1, wherein the first side portion includes a first front plate forming a front of the first housing, a first side front plate forming the front and a part of a right side of the first housing, a first side back plate forming a part of the right side and a part of a back of the first housing, and a first fin guard forming a part of the back and a left side of the first housing, the first front plate includes a first bell mouth provided at a position facing the first air blower, the first air-blower support frame includes a first front-plate attachment portion which supports the first front plate and is bent forward at the upper end of the first air-blower support frame, a first heat exchanger support portion which supports the first heat exchanger and is bent toward a back side at the upper end of the first air-blower support frame, and the first upper-portion attachment portion at a position between the first upper-portion attachment portion and the first heat exchanger support portion formed at the upper end of the first air-blower support frame, the second side portion includes a second front plate forming a front of the second housing, a second side front plate forming the front and a part of a right side of the second housing, a second side back plate forming a part of the right side and a part of a back of the second housing, and a second fin guard forming a part of the back and a left side of the second housing, the second front plate includes a second bell mouth provided at a position facing the second air blower, the outdoor unit further comprises a first fan guard which covers the first bell mouth and a second fan guard which covers the second bell mouth, and the second air-blower support frame includes a second front-plate attachment portion which supports the second front plate and is bent forward at the upper end of the second air-blower support frame, a second heat exchanger support portion which supports the second heat exchanger and is bent toward a back side at the upper end of the second air-blower support frame, and the second upper-portion attachment portion at a position between the second upper-portion attachment portion and the second heat exchanger support portion formed at the upper end of the second air-blower support frame.

3. The outdoor unit of claim 1, wherein the first housing and the second housing include connection portions which connect the first housing and the second housing.

4. The outdoor unit of claim 1, further comprising a third housing stacked on the second housing, wherein the top plate is attached onto the third housing and forms the ceiling portion, and the third housing includes:

a third side portion stacked on the second side portion;

a third partition plate which is stacked on the second partition plate and divides a space surrounded by the third side portion into a third heat exchange compartment and a third machine compartment;

a third heat exchanger stacked on the second heat exchanger and accommodated in the third heat exchange compartment;

a third air blower accommodated in the third heat exchange compartment; and a third air-blower support frame which is stacked on the second upper-portion attachment portion of the second air-blower support frame and supports the third air blower and the third heat exchanger, and wherein the third air-blower support frame includes a third base-plate attachment portion attached onto the second upper-portion attachment portion of the second air-blower support frame at a lower end of the third air-blower support frame, a third upper-portion attachment portion at an upper end of the third air-blower support frame, and a third blower attachment portion which supports the third air-blower at a position between the lower end of the third air-blower support frame and the upper end of the third air-blower support frame.

5. The outdoor unit of claim 4, wherein the third side portion includes a third front plate forming a front of the third housing, a third side front plate forming the front and a part of a right side of the third housing, a third side back plate forming a part of the right side and a part of a back of the third housing, and a third fin guard forming a part of the back and a left side of the third housing, the third front plate includes a third bell mouth provided at a position facing the third air blower, the outdoor unit further comprises a third fan guard which covers the third bell mouth, and the third air-blower support frame includes a third front-plate attachment portion which supports the third front plate and is bent forward at the upper end of the third air-blower support frame, a third heat exchanger support portion which supports the third heat exchanger and is bent toward a back side at the upper end of the third air-blower support frame, and the third upper-portion attachment portion at a position between the third upper-portion attachment portion and the third heat exchanger support portion formed at the upper end of the third air-blower support frame.

6. The outdoor unit of claim 4, wherein the second housing and the third housing include connection portions which connect the second housing and the third housing.

7. The outdoor unit of claim 4, further comprising an electrical parts box which is formed integrally with the second partition plate and accommodates drive control parts for the first, second and third air blowers and the compressor.

* * * * *